United States Patent [19]

Coon

[11] Patent Number: 4,632,351

[45] Date of Patent: Dec. 30, 1986

[54] FINGER RING HOLDER WITH RETRACTABLE RETAINERS

[76] Inventor: Robert E. Coon, 2567 N. 400 West, Layton, Utah 84041

[21] Appl. No.: 742,470

[22] Filed: Jun. 7, 1985

[51] Int. Cl.[4] ..... A47F 5/00

[52] U.S. Cl. ..... 248/309.2; 206/566; 211/13

[58] Field of Search ..... 248/309.2, 309.1, 231.9, 248/224.4, 442, 115; 211/13, 54.1, 57.1, 59.1; D6/567, 553, 569, 566; 24/3 R; 206/566, 477; 411/344

[56] References Cited

U.S. PATENT DOCUMENTS

| | | | |
|---|---|---|---|
| 1,590,172 | 6/1926 | Thorberg | 211/59.1 X |
| 1,590,591 | 6/1926 | Steffets | 211/59.1 |
| 2,205,298 | 6/1940 | Lindner | 211/59.1 |
| 2,578,237 | 12/1951 | Geistweit | 248/309.1 X |
| 2,717,472 | 9/1955 | Wilmington | 248/309.2 X |
| 3,420,468 | 1/1969 | Rhoades | 211/59.1 X |
| 3,718,260 | 2/1973 | Sharp | 211/13 |
| 4,264,013 | 4/1981 | Vollmer | 248/309.2 X |
| 4,300,684 | 11/1981 | Smith et al. | 211/57.1 X |

*Primary Examiner*—J. Franklin Foss
*Assistant Examiner*—David L. Talbott
*Attorney, Agent, or Firm*—A. Ray Osburn

[57] ABSTRACT

A finger ring retainer for safe storage of such rings when temporarily removed from the finger for bathing, dishwashing or the like. The device comprises a base mounted stem with retractable reeds which retain the ring in safe storage position about the stem, a spring loaded plunger being depressed to retract the reeds as the ring is slipped from the finger onto the stem and vice versa.

9 Claims, 10 Drawing Figures

FINGER RING HOLDER WITH RETRACTABLE RETAINERS

BACKGROUND OF THE INVENTION

1. Field

The field of the invention is devices for temporarily holding rings when they are removed from the finger for sleeping, personal toiletry or household chores.

2. State of the Art

The problem of the inadvertent loss of valuable jewelry rings down sink drains, commodes, registers or the like is very widespread. Because of fear of loss, rings often are not removed while the wearer baths, soaps and washes hands, or washes dishes. Retaining the ring upon the finger during these activities is dangerous also. Jewels are loosened and dislodged from settings, and rings lubricated by soap and water slip from fingers. Rings are lost also when presumed to be in safe storage upon shelves and counter tops, or upon clothes hooks from which they are easily dislodged. Yet, to the knowledge of the inventor, the prior art includes no positive retention device for temporary ring storage in the home, with the possible exception of lidded jewelry boxes. While the art does disclose spring-grip towel holders and the like, (U.S. Pat. Nos. 2,504,910 and 4,290,575) none are adapted for storage of finger rings. Some devices for jewelry display utilize resilient spring leaves for retention of finger rings, but none suggest provisions for safe transfer of the ring from the finger to the holder. (U.S. Pat. No. 1,907,681) Clothes-hanger hooks and the like may be used, but inadvertent dislodgment and subsequent loss is a dangerous possibility.

BRIEF SUMMARY OF THE INVENTION

With the foregoing in mind, the present invention eliminates or substantially alleviates the disadvantages and shortcomings in the prior art, by providing a device upon which a finger ring may be placed upon removal from the finger, automatically retained thereon, and subsequently returned to the finger without danger of inadvertent loss of control of the ring. The device comprises a stem about which the ring is placed, the stem preferably carried by a base adapted to be attached to a wall, counter or table top with the stem projecting therefrom. One or more normally extended but retractable members project from the stem to prevent accidental dislodgment of the stored ring. The ring-retaining members are retractable by actuation of a member with the tip of the ring finger, so that the ring may be safely transferred and retained, the retracted members returning to extended position upon removal of the finger. Preferably, the actuation member is a plunger axially slideable within the tubular stem and spring loaded, and the retractable members are elongate reeds of flexible material secured at one of their ends to the plunger and extending outwardly radially through longitudinal slots provided in the tubular stem.

It is therefore the principal object of the invention to provide a device for the safe transfer, retention and replacement of rings from fingers without inadvertent loss of control thereof resulting in loss of the ring down drains, registers and the like.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
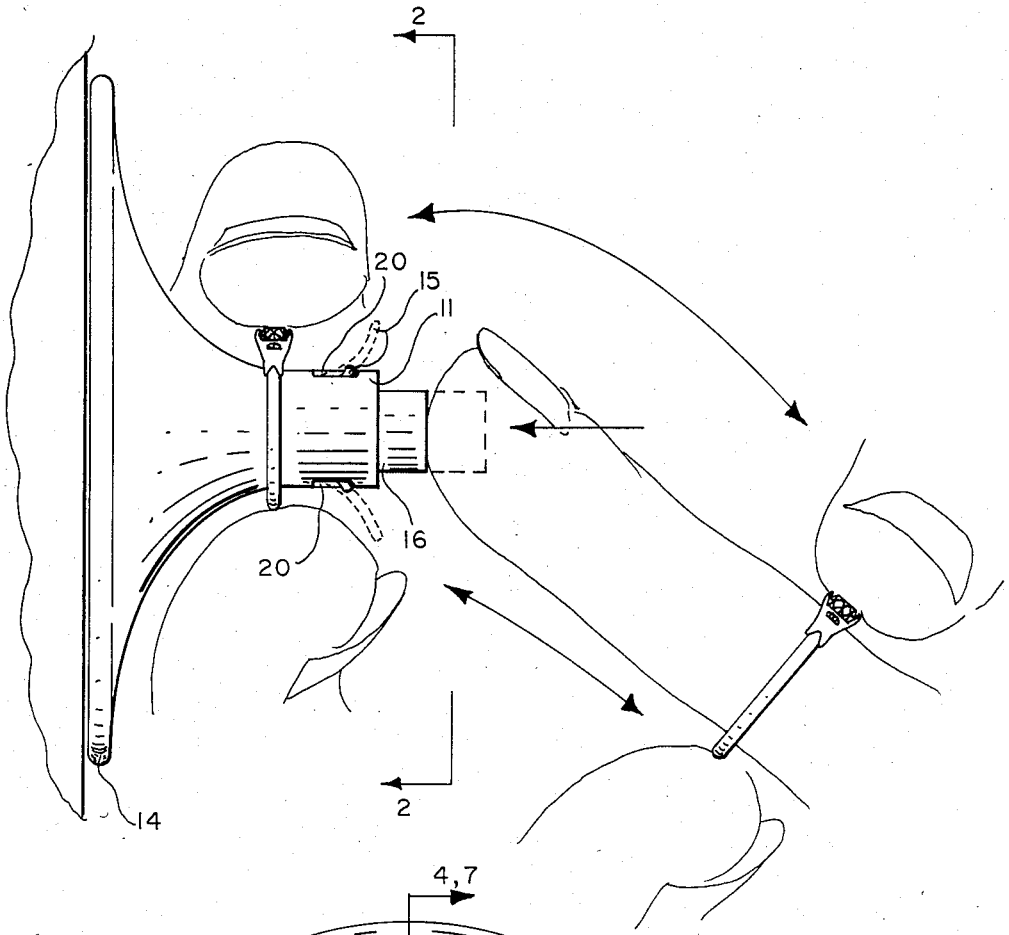
FIG. 1 is a side elevational view of a finger ring retainer in accordance with the invention, said retainer being secured to a vertical wall, illustrating the placement of a finger ring directly from the finger onto the stem of the retainer, the spring retaining reeds being shown in extended position in dashed lines, drawn to a somewhat enlarged scale, FIG. 2 an elevational view of the ring retainer of FIG. 1, taken along line 2—2 thereof, a ring being shown secured about the stem thereof, drawn to the same scale as FIG. 1, FIG. 3 a side elevational view of the ring retainer of FIG. 1, illustrating a ring in safe storage about the stem of said retainer with the retaining reeds extended, to scale of FIG. 1, FIG. 4 a vertical cross sectional view of the ring retainer of FIG. 2, taken along line 4—4 thereof, drawn to the same scale, FIG. 5 a horizontal cross sectional view of a fragment of the ring retainer of FIG. 2 showing a fragment of the plunger held in extended position by the spring and the internal shoulder of the stem, drawn to the same scale as FIG. 2, FIG. 6 a vertical cross sectional view of the stem of the ring retainer of FIG. 4 showing the reed guide slots of the stem, drawn to the scale of FIG. 4, FIG. 7 a vertical cross sectional view of the ring retainer of FIG. 2 with the plunger in depressed position and the ring retaining reeds in corresponding retracted position, drawn to the scale of FIG. 2, FIG. 8 a perspective view of the flexible reeds integral with the reed collar, separated from the ring retainer of FIGS. 1–7, drawn to the same scale, FIG. 9 a cross sectional view of a fragment of another embodiment in accordance with the invention, drawn to the scale of FIGS. 1–8, and FIG. 10 a cross sectional view of a fragment of still another embodiment in accordance with the invention, drawn to the scale of FIGS. 1–9.
Figure 2:
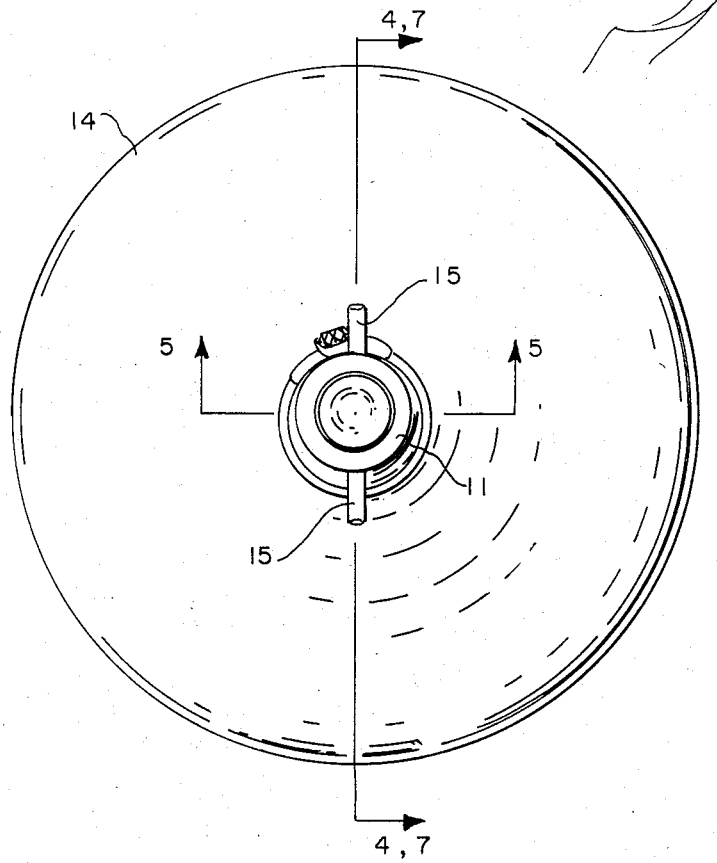
Figure 3:
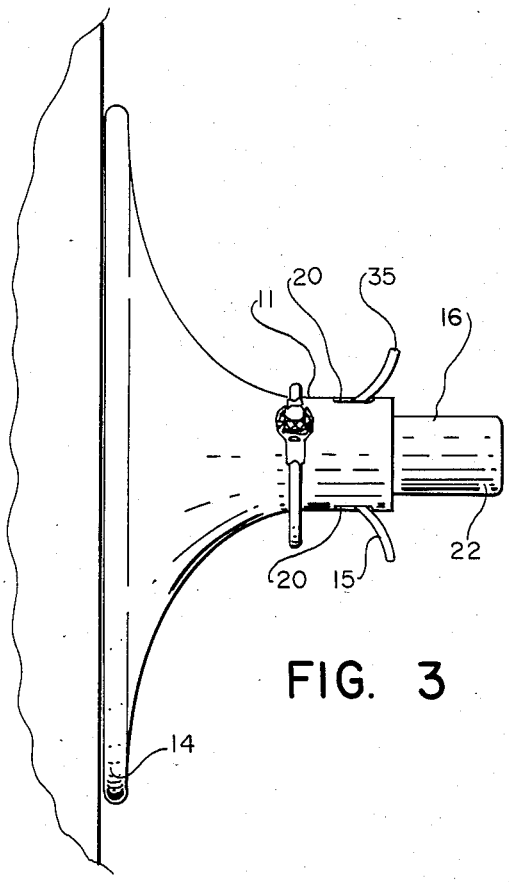

The illustrated finger ring retainer 10 comprises a stem 11 about which the finger ring is directly placed as it is taken from the finger for sleep, bathing, dishwashing or the like. Ring retainer 10 is advantageously secured upon a conveniently located wall, counter top or table, as by adhesive 12, which may be provided upon an annular plane surface 13 of the bottom of a base 14. Inadvertent removal or dislodgment of the ring from stem 11 is prevented by radially projecting reeds 15. Reeds 15 must be retracted to place or remove the ring from stem 11, as subsequently discussed. (FIGS. 1–3)

Figure 4:
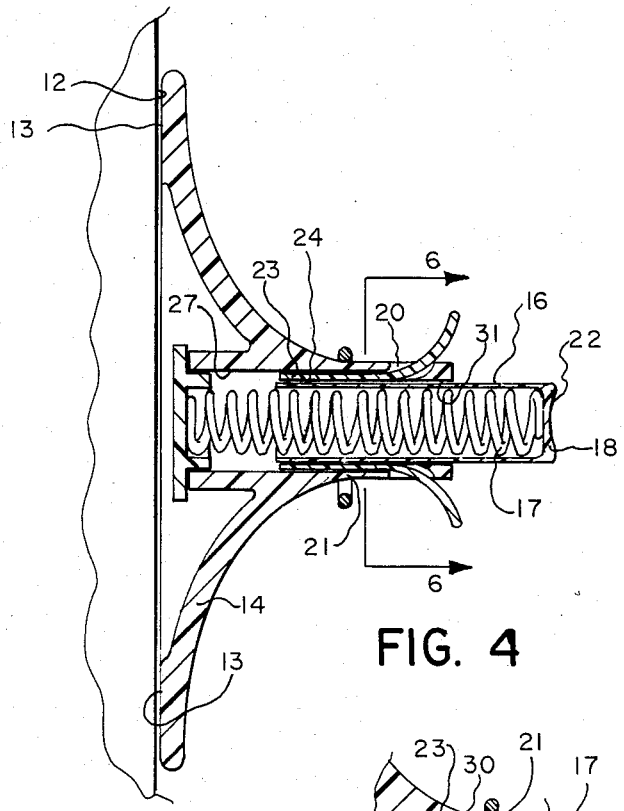
Figure 5:
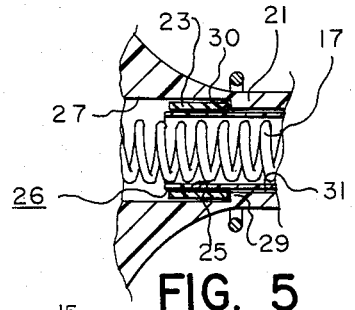
Figure 6:
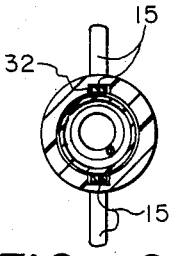
Figure 7:
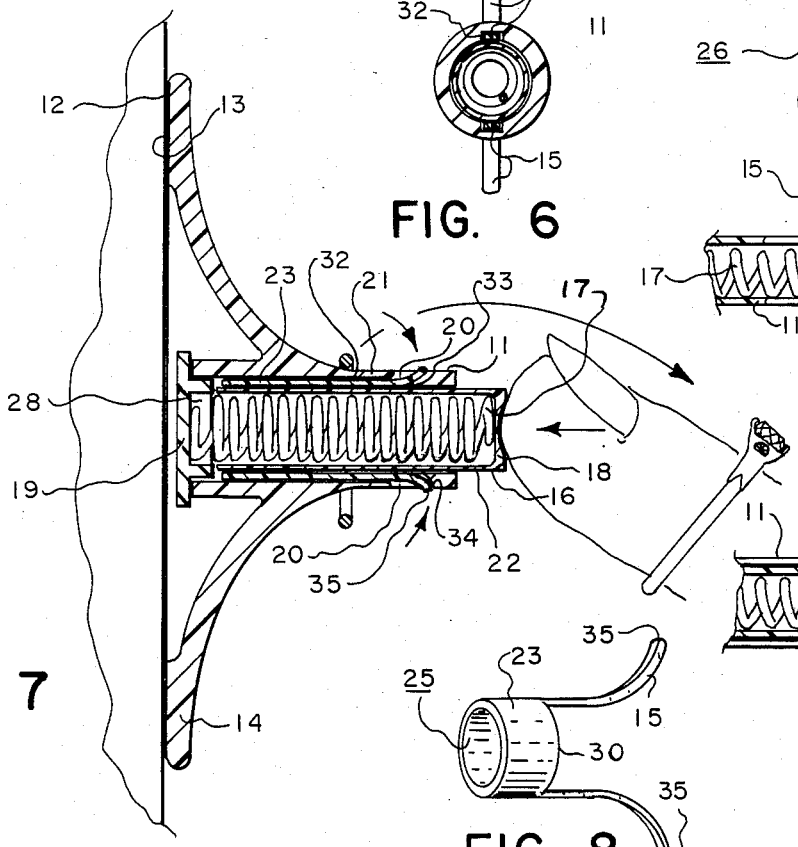

The reeds 15 are in the illustrated embodiment carried upon a telescoping tubular plunger 16, which is adapted to slide reciprocally within stem 11. A compression spring 17 within plunger 16, acting between plunger end wall 18 and a stem tube end cap 19, holds plunger 16 in its outermost position, each reed 15 extending through a matching alongate window slot 20 through wall 21 of stem 11. End cap 19 may be secured by adhesive, press-fitting or the like to stem 11. (FIGS. 4 and 7)

To place the ring upon stem 11, plunger 16 is depressed against spring 17 by the tip of the ring finger on plunger end 22 to cause reeds 15 to retract through window slots 20. Then, the thumb and forefinger of the other hand may be used to slide the ring from the finger directly into storage position around stem 11. The ring finger tip remains in contact with the end 22 of plunger 16, eliminating all possibility of dropping the ring during transfer. To return the ring to the finger, plunger 16 is again depressed by the tip of the ring finger, to retract reeds 15, and the thumb and finger of the other hand again used, to slide the ring from stem 11 past slots 20 safely back onto the ring finger. (FIG. 1)

Advantageously, reeds 10 may be of nylon or other elastic plastic, preferably molded in curved form to extend radially through slots 20. A tubular collar 23, integral with the reeds 15, is preferably sized to closely fit about plunger tube 16. Glue 24 may be used on inside surface 25 of collar 24 to secure it to the outside surface 26 of plunger 16. A relatively large diameter portion 27 of internal bore 28 of stem 16 accommodates collar 23 and ends with a shoulder 29 serving to stop plunger 16 by action against end 30 of collar 23. (FIGS. 4–8)

Smaller bore portion 31 has a longitudinal guide slot 32 for each reed 15. Guide slots 32 terminate in the reed window slots 20 through wall 21 of stem 11. The window slots 20 are bevelled at each end for smooth action against the reeds as they are extended and retracted. In particular, the outermost end 33 of each has a bevel 34 to guide ends 35 of each reed into extended position. It is noted that the elastic reeds 15 are not necessarily curved since the bevels 34 induce the necessary bends for reed extension.

Figure 9:
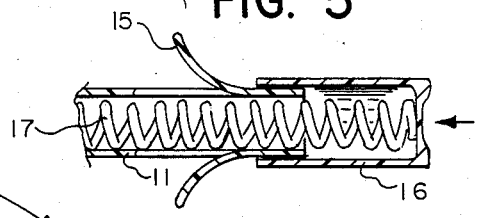
Figure 10:
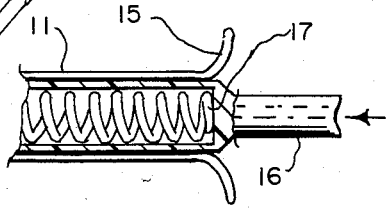
Figure 8:
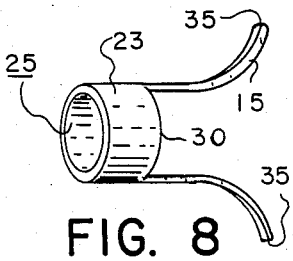

Ring retainer 10 is advantageously constructed of molded plastic, although other materials may be employed without departing from the spirit of the invention. Plunger tube 16 could be of metal or other material, as could cap 19 and retractable reeds 15. Even plunger spring 17 could be made of metallic material or of selected elastic plastic material, the latter in fact attractively providing corrosion resistance in humid locations near bathrooms or kitchen sinks. Other mechanical arrangements providing for the retraction of reeds 15, or of functionally equivalent ring-retaining members, could be utilized without departing from the spirit of the invention. For example, reeds 15 could be substantially rigid and hingedly attached to plunger 16, guided to extended position by bevel 34. Elastic reeds 15 could, for example be secured to stem tube 11, held extended by a dual-diameter plunger 16 and formed to retract when it is depressed. (FIG. 10) Nor do reeds 15 necessarily extend angled away from base 14 as illustrated; other equivalent embodiments might be associated with reeds angled instead toward base 14. For example, reeds 15 could be integral with stem 11, and plunger 16 adapted to slide on the outside to depress the reeds. (FIG. 9)

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. A finger ring retainer comprising:

an elongate stem sized to accept a finger ring therearound; and normally extended retractable means preventing the removal of the ring from the stem, said means being retractable by pressure exerted by the tip of the finger directed along the longitudinal axis of the stem, when the finger is in position for moving the ring therefrom directly onto the stem.

2. The finger ring retainer of claim 1, further comprising:

means for securing the stem projecting away from the surface of a wall, counter top or the like.

3. A finger ring retainer comprising:

an elongate tubular stem having an open end and being sized at said end to accept a finger ring therearound;

an elongate plunger disposed slideably within the stem with an end portion thereof extending outwardly from the open end of the stem;

means preventing further movement of the plunger outwardly from the stem;

spring means resistably permitting insertion of the plunger slideably more deeply into the stem by force upon said outwardly extending portion of the plunger;

at least one normally extended retractable member for retaining the finger ring upon the stem, said member being retracted by said forceable insertion of the plunger.

4. The finger ring retainer of claim 3, wherein:

the elongate retractable member is resilient, secured at one of its ends to the plunger, permanently curved outwardly from the stem to retain the ring thereon, and elastically retracted by contact with the wall of the stem when the plunger is forceably depressed into the stem.

5. The finger ring retainer of claim 4, wherein:

the tubular stem further comprises a slot through the wall thereof through which the retractable member extends and retracts as the plunger is respectively released and depressed.

6. The finger ring retainer of claim 3, wherein:

the elongate retractable member is elastic and secured at one of its ends to the plunger, and the stem further comprises a closed-end, elongate window slot through its wall with the end of the slot proximate the open end of the stem configured to guide the member bendingly through the slot to project outwardly from the stem when the plunger slides outwardly with respect to the stem.

7. The finger ring retainer of claim 3, further comprising:

means for securing the stem projecting outwardly from the surface of a wall, table top or the like.

8. The finger ring retainer of claim 5, wherein:

the stem further comprises a base member adapted to support the stem upwardly projecting from a counter, table top or the like.

9. The finger ring retainer of claim 8, further comprising:

means for securing the base member upon the surface of a wall with the stem projecting outwardly therefrom.

* * * * *